US009082412B2

(12) United States Patent
Kawashima et al.

(10) Patent No.: US 9,082,412 B2
(45) Date of Patent: Jul. 14, 2015

(54) DECODER, ENCODER, AND METHODS THEREOF

(75) Inventors: Takuya Kawashima, Ishikawa (JP); Masahiro Oshikiri, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 361 days.

(21) Appl. No.: 13/702,382

(22) PCT Filed: May 27, 2011

(86) PCT No.: PCT/JP2011/002965

§ 371 (c)(1),
(2), (4) Date: Dec. 6, 2012

(87) PCT Pub. No.: WO2011/155144

PCT Pub. Date: Dec. 15, 2011

(65) Prior Publication Data

US 2013/0085752 A1 Apr. 4, 2013

(30) Foreign Application Priority Data

Jun. 11, 2010 (JP) ..... 2010-134127

(51) Int. Cl.
*G10L 21/00* (2013.01)
*G10L 21/034* (2013.01)
(Continued)

(52) U.S. Cl.
CPC ..... *G10L 21/034* (2013.01); *G10L 19/22* (2013.01); *G10L 19/0204* (2013.01); *G10L 19/0212* (2013.01); *G10L 19/12* (2013.01); *G10L 19/24* (2013.01)

(58) Field of Classification Search
None
See application file for complete search history.

(56) References Cited

U.S. PATENT DOCUMENTS 4,184,049 A * 1/1980 Crochiere et al. ..... 704/229
6,134,518 A * 10/2000 Cohen et al. ..... 704/201
(Continued)

FOREIGN PATENT DOCUMENTS

CA 2700911 4/2009
CN 101199005 6/2008
(Continued)

OTHER PUBLICATIONS

Search report from E.P.O., mail date is Sep. 10, 2013.
(Continued)

*Primary Examiner* — Richemond Dorvil
*Assistant Examiner* — Thuykhanh Le
(74) *Attorney, Agent, or Firm* — Greenblum & Bernstein, P.L.C.

(57) ABSTRACT

Disclosed is a decoder capable of improving the sound quality of a decoded sound signal in an encoding method which combines speech encoding and music encoding in a hierarchical structure. A transform-encoding decoding unit (202) decodes transform-encoded data to generate a spectrum of a decoded transform-encoded signal. A band decision unit (203) uses the spectrum of the decoded transform-encoded signal to decide whether each of a plurality of bands in which frequency components of an input signal are divided constitute a first band in which a transform encoded pulse is not established or a second band in which said pulse is established. A CELP component suppression unit (207) suppresses the spectrum of a CELP decoded signal, which is the frequency component of a decoded signal of CELP encoded data, to the extent that suppression in the first band is weaker than suppression in the second band.

5 Claims, 8 Drawing Sheets

(51) Int. Cl.

| | |
|---|---|
| ***G10L 19/22*** | (2013.01) |
| *G10L 19/12* | (2013.01) |
| *G10L 19/02* | (2013.01) |
| *G10L 19/24* | (2013.01) |

(56) References Cited

U.S. PATENT DOCUMENTS

| | | | | |
|---|---|---|---|---|
| 8,150,684 | B2 | 4/2012 | Kawashima et al. | |
| 8,160,868 | B2 | 4/2012 | Kawashima et al. | |
| 8,370,138 | B2 | 2/2013 | Kawashima et al. | |
| 8,515,767 | B2 | 8/2013 | Reznik | |
| 2008/0126085 | A1* | 5/2008 | Morii | 704/222 |
| 2009/0112607 | A1 | 4/2009 | Ashley et al. | |
| 2009/0216527 | A1* | 8/2009 | Oshikiri | 704/228 |
| 2009/0240491 | A1* | 9/2009 | Reznik | 704/219 |
| 2009/0326930 | A1 | 12/2009 | Kawashima et al. | |
| 2010/0017199 | A1* | 1/2010 | Oshikiri et al. | 704/205 |
| 2010/0017200 | A1* | 1/2010 | Oshikiri et al. | 704/207 |
| 2010/0049509 | A1 | 2/2010 | Kawashima et al. | |
| 2010/0232619 | A1 | 9/2010 | Uhle et al. | |
| 2010/0280833 | A1* | 11/2010 | Yamanashi et al. | 704/500 |
| 2010/0332221 | A1* | 12/2010 | Yamanashi et al. | 704/207 |
| 2011/0010169 | A1* | 1/2011 | Vasilache et al. | 704/222 |
| 2013/0138434 | A1* | 5/2013 | Furuta et al. | 704/226 |
| 2013/0166308 | A1* | 6/2013 | Kawashima et al. | 704/500 |
| 2013/0246056 | A1* | 9/2013 | Sugiyama | 704/205 |
| 2013/0317811 | A1* | 11/2013 | Grancharov et al. | 704/203 |

FOREIGN PATENT DOCUMENTS

| | | |
|---|---|---|
| WO | WO2006/134992 | 12/2006 |
| WO | WO2008/084688 | 7/2008 |
| WO | 2009/059333 | 5/2009 |

OTHER PUBLICATIONS

"Recommendation ITU-T G.718.2008", Jun. 2008, pp. 151-158.

* cited by examiner

DECODER, ENCODER, AND METHODS THEREOF

TECHNICAL FIELD

The present invention relates to a decoding apparatus, and a coding apparatus and decoding and coding methods.

BACKGROUND ART

A coding method is proposed which combines a CELP (Code Excited Linear Prediction) coding method suitable for a speech signal with a transform coding method suitable for a music signal in a layer structure, as a coding method which can compress speech and music and so forth at a low bit rate and with high sound quality (see for example, Non-Patent Literature 1). Hereinafter, a speech signal and a music signal are collectively referred to as an audio signal.

In the coding method, a coding apparatus first encodes an input signal by a CELP coding method to generate CELP coded data. The coding apparatus then converts a residual signal (hereinafter, referred to as a CELP residual signal) between the input signal and a CELP decoded signal (a decoded result of the CELP coded data) into the frequency domain to acquire a residual spectrum and performs transform coding on the residual spectrum, thereby providing a high sound quality. A transform coding method is proposed which generates pulses at frequencies having a high residual spectrum energy and encodes information of the pulses (see, Non-Patent Literature 1).

While the CELP coding method is suitable for speech signal coding, the coding model of the CELP coding method is different from that of a music signal, and therefore sound quality degrades in coding the music signal through the CELP coding method. For this reason, the CELP residual signal component is large when the music signal is encoded by the above coding method, and thereby raising a problem that sound quality is less likely to be improved in encoding the CELP residual signal (residual spectrum) by the transform coding.

To solve this problem, a coding method (a CELP component suppressing method) is proposed which suppresses the amplitude of a frequency component of the CELP decoded signal (hereinafter, referred to as a CELP component) to calculate a residual spectrum and performs transform coding on the calculated residual spectrum to provide high sound quality (see, for example, Patent Literature 1 and Non-Patent Literature 1 (section 6.11.6.2)).

The CELP component suppressing method disclosed in Non-Patent Literature 1 suppresses the amplitude of the CELP component (hereinafter, referred to as CELP suppressing) in only a middle band of 0.8 kHz to 5.5 kHz when a sampling frequency for an input signal is 16 kHz. In Non-Patent Literature 1, the coding apparatus does not directly perform transform coding on the CELP residual signal, and reduces the residual signal of a CELP component by another transform coding method beforehand (see, for example, Non-Patent Literature 1 (Section 6.11.6.1)). For this reason, the coding apparatus does not perform CELP suppressing on a frequency component coded by the other transform coding method even in the middle band. A CELP suppressing coefficient indicating the degree of CELP suppressing (level) is constant in frequencies in the middle band other than frequencies in which the CELP suppressing is not performed. The CELP suppressing coefficients are stored in a code book (hereinafter, referred to as a CELP component suppressing code book) according to the level of the CELP suppressing.

The CELP component suppressing code book stores a coefficient (=1.0) meaning that no CELP component is suppressed.

The coding apparatus performs CELP suppressing by multiplying the CELP component (a CELP decoded signal) by the CELP suppressing coefficient stored in the CELP component suppressing code book before the transform coding, acquires the residual spectrum between the input signal and the CELP decoded signal (a CELP decoded signal after the CELP suppressing), and performs transform coding on the residual spectrum. The coding apparatus then calculates a residual signal between the input signal and a signal obtained by adding a decoded signal of the transform-coded data and the CELP decoded signal in which the CELP component is suppressed, searches for a CELP suppressing coefficient such that an energy of the residual signal (hereinafter, referred to as a coding distortion) is minimum by a closed loop, and encodes the searched CELP suppressing coefficient. By this means, the coding apparatus can perform transform coding which minimizes the coding distortion in all bands. Meanwhile, a decoding apparatus suppresses the CELP component of the CELP decoded signal using the CELP suppressing coefficient transmitted from the coding apparatus and adds a decoded signal subjected to transform coding to the CELP decoded signal in which the CELP component is suppressed. This allows the decoding apparatus to acquire a decoded signal having less deterioration of sound quality due to CELP coding when performing coding which combines the CELP coding and the transform coding in a layer structure.

CITATION LIST

Patent Literature

PLT 1
U.S. Patent Application Publication No. 2009/0112607 Specification

Non-Patent Literature

NPL 1
Recommendation ITU-T G.718, June, 2008

SUMMARY OF INVENTION

Technical Problem

Suppressing the CELP component of the CELP decoded signal by the above CELP component suppressing method causes suppression of the CELP component in a band having a small residual signal between the input signal and the CELP decoded signal and leads to a loss of an effect of improving sound quality by the CELP coding (in other words, a contribution to an improvement of sound quality by the CELP coding). In other words, a problem occurs that the use of the CELP component suppressing method rather deteriorates sound quality depending on a band.

The above problem will be explained in detail with reference to FIG. 1.

FIGS. 1A and 1B show logarithmic powers (amplitudes) of an input signal spectrum in the frequency domain (a dotted line), a CELP decoded signal spectrum (a dashed line), and a suppressed CELP decoded signal spectrum which is a CELP decoded signal spectrum after CELP suppressing (a solid line). To simplify the explanation, a case of uniformly performing CELP suppressing in all bands will be described in FIGS. 1A and 1B. In FIGS. 1A and 1B, an input signal is assumed to be a music signal with a vocal. In other words, a contribution of a speech spectrum is large in lower bands (f0 to f1) and a contribution of spectrum of an instrument and the like is large in bands equal to or more than a middle band (f1 to f2) as shown in FIGS. 1A and 1B. Non-Patent Literature 1 limits a band for performing CELP suppressing to a band from 0.8 kHz to 5.5 kHz, and the problem described below similarly occurs in Non-Patent Literature 1.

As shown in FIG. 1A, a coding apparatus performs CELP suppressing on a spectrum amplitude of a CELP decoded signal spectrum (a CELP component) at each frequency, using a CELP suppressing coefficient selected by a closed loop search, and acquire a suppressed CELP decoded signal spectrum. The coding apparatus encodes a CELP residual signal which is the difference between an input signal spectrum and the suppressed CELP decoded signal spectrum, by transform coding.

As shown in FIG. 1B, pulses are generated by transform coding at frequencies (f3, f4, f5, f6, f7, f8, f9) having a large difference between the input signal spectrum (a dotted line) and the suppressed CELP decoded signal spectrum (a solid line), in a band (f1 to f2) having a large contribution of a spectrum of an instrument and the like. On the other hand, a CELP component is suppressed by CELP suppressing at frequencies in which no pulse is generated by transform coding, and consequently, a noise component (hereinafter, referred to as a noise floor) of a spectrum attenuates, in FIG. 1B. Here, the noise floor is a signal component having a low energy. The CELP coding method is not suitable for encoding a signal component such as the noise floor, and therefore the noise floor is larger than an input signal, so that noise may be emphasized. Accordingly, it is possible to achieve clear sound quality with noise reduced by the effect of attenuating the noise floor by the CELP suppressing, as described above.

On the other hand, a contribution of the CELP coding is large in the band (f0 to f1) having a large contribution of a speech spectrum as described above, and therefore a CELP residual signal is small in FIG. 1B. For this reason, no pulse is generated by transform coding in a band (f0 to f1) as shown in FIG. 1B, a decoded signal spectrum acquired in a decoding apparatus equals to a suppressed CELP decoded signal spectrum.

As shown in FIG. 1A, a CELP residual signal through CELP coding is small and a spectrum is acquired in which a CELP decoded signal spectrum (a dashed line) substantially equals to an input signal spectrum (a dotted line), in the band (f0 to f1). Suppressing the CELP component to the suppressed CELP decoded signal spectrum (a solid line) through the CELP suppressing reduces the contribution to an improvement of sound quality that results from the CELP coding. In other words, the CELP suppressing causes a deterioration of sound quality in the band (f0 to f1) having a large contribution to the improvement of sound quality by the CELP coding. A case of using music with a vocal has been described herein, but the present invention is not limited thereto, and a contribution of the CELP coding may vary depending on a band with regard to a general music signal.

It is an object of the present invention to provide a decoding apparatus, a coding apparatus, and decoding and coding methods that can improve sound quality of a decoded audio signal by determining the degree of contribution to a sound quality improvement of coding suitable for a speech signal in every band based on a result of coding suitable for a music signal and adaptively performing a control for suppressing on the amplitude of a spectrum in every band, in a coding method which combines coding suitable for a speech signal with coding suitable for a music signal in a layer structure.

Solution to Problem

A decoding apparatus according to a first aspect of the present invention is a decoding apparatus that receives and decodes first coded data generated through speech coding and second coded data generated through music coding, and employs a configuration to include a first decoding section that performs an orthogonal transformation on a signal obtained by decoding the first coded data, to generate a first spectrum; a second decoding section that decodes the second coded data to generate a second spectrum; a identification section that identifies a first band in which a degree of suppression of the amplitude of the first spectrum is adjusted, using the second spectrum; and a suppressing section that suppresses the amplitude of the first band of the first spectrum based on the adjusted degree.

A coding apparatus according to a second aspect of the present invention employs a configuration to include a first coding section that encodes an input signal through speech coding to generate a first code and performs an orthogonal transformation on a signal obtained by decoding the first code, to generate a first spectrum; a spectrum generating section that performs the orthogonal transformation on the input signal to generate a second spectrum; a band selection section that divides a frequency band into a plurality of bands, selects a preset number of bands based on an energy of a residual signal between the first spectrum and the second spectrum, generates band selection information indicating information about the selected band, outputs a spectrum of the selected band in the first spectrum as a first selected spectrum, and outputs a spectrum of the selected band in the second spectrum as a second selected spectrum; a suppressing section that suppresses the amplitude of the first selected spectrum using a suppressing coefficient representing the degree of suppression and generates a suppressed spectrum; a residual spectrum calculating section that calculates a difference between the second selected spectrum and the suppressed spectrum to generate a residual spectrum; a second coding section that encodes the residual spectrum through music coding to generate a second code, and decodes the second code to generate a decoded residual spectrum; a decoded spectrum generating section that generates a decoded spectrum using the suppressed spectrum and the decoded residual spectrum; and a distortion evaluating section that calculates distortion between the second selected spectrum and the decoded spectrum and searches for the suppressing coefficient which minimizes the distortion.

A decoding method according to a third aspect of the present invention is a method that receives and decodes first coded data generated through speech coding and second coded data generated through music coding, and employs a configuration to include a first decoding step of performing an orthogonal transformation on a signal obtained by decoding the first coded data, to generate a first spectrum; a second decoding step of decoding the second coded data to generate a second spectrum; an identification step of identifying a first band in which a degree of suppression of the amplitude of the first spectrum is adjusted, using the second spectrum; and a suppressing step of suppressing the amplitude of the first band of the first spectrum based on the adjusted degree.

A coding method according to a fourth aspect of the present invention employs a configuration to include a first coding step of encoding an input signal through speech coding to generate a first code and performing an orthogonal transformation on a signal obtained by decoding the first code to generate a first spectrum; a spectrum generating step of performing the orthogonal transformation on the input signal to generate a second spectrum; a band selection step of dividing a frequency band into a plurality of bands, selecting a preset number of bands based on an energy of a residual signal between the first spectrum and the second spectrum, generating band selection information indicating information about the selected band, outputting a spectrum of the selected band in the first spectrum as a first selected spectrum, and outputting a spectrum of the selected band in the second spectrum as a second selected spectrum; a suppressing step of suppressing the amplitude of the first selected spectrum using a suppressing coefficient representing the degree of suppression and generates a suppressed spectrum; a residual spectrum calculating step of calculating a difference between the second selected spectrum and the suppressed spectrum to generate a residual spectrum; a second coding step of encoding the residual spectrum through music coding to generate a second code, and decoding the second code to generate a decoded residual spectrum; a decoded spectrum generating step of generating a decoded spectrum using the suppressed spectrum and the decoded residual spectrum; and a distortion evaluating step of calculating distortion between the second selected spectrum and the decoded spectrum and searches for the suppressing coefficient which minimizes the distortion.

Advantageous Effects of Invention

According to the present invention, it is possible to improve sound quality of a decoded audio signal in a coding method which combines coding suitable for a speech signal with coding suitable for a music signal in a layer structure.

DESCRIPTION OF EMBODIMENTS

Hereinafter, embodiments of the present invention will be explained in detail with reference to the accompanying drawings. A coding apparatus and a decoding apparatus according to the present invention will be described using an audio coding apparatus and an audio decoding apparatus as examples. As described above, a speech signal and a music signal are collectively referred to as an audio signal. In other words, the audio signal represents any of the only substantive speech signal, the only substantive music signal, the mixture of the speech signal and the music signal.

A coding apparatus and a decoding apparatus according to the present invention include at least two coding layers. Hereinafter, CELP coding is employed for coding suitable for a speech signal and transform coding is employed for coding suitable for a music signal as a representative, and the coding apparatus and the decoding apparatus each employ a coding method which combines CELP coding and transform coding in a layer structure.

Embodiment 1

Figure 2:
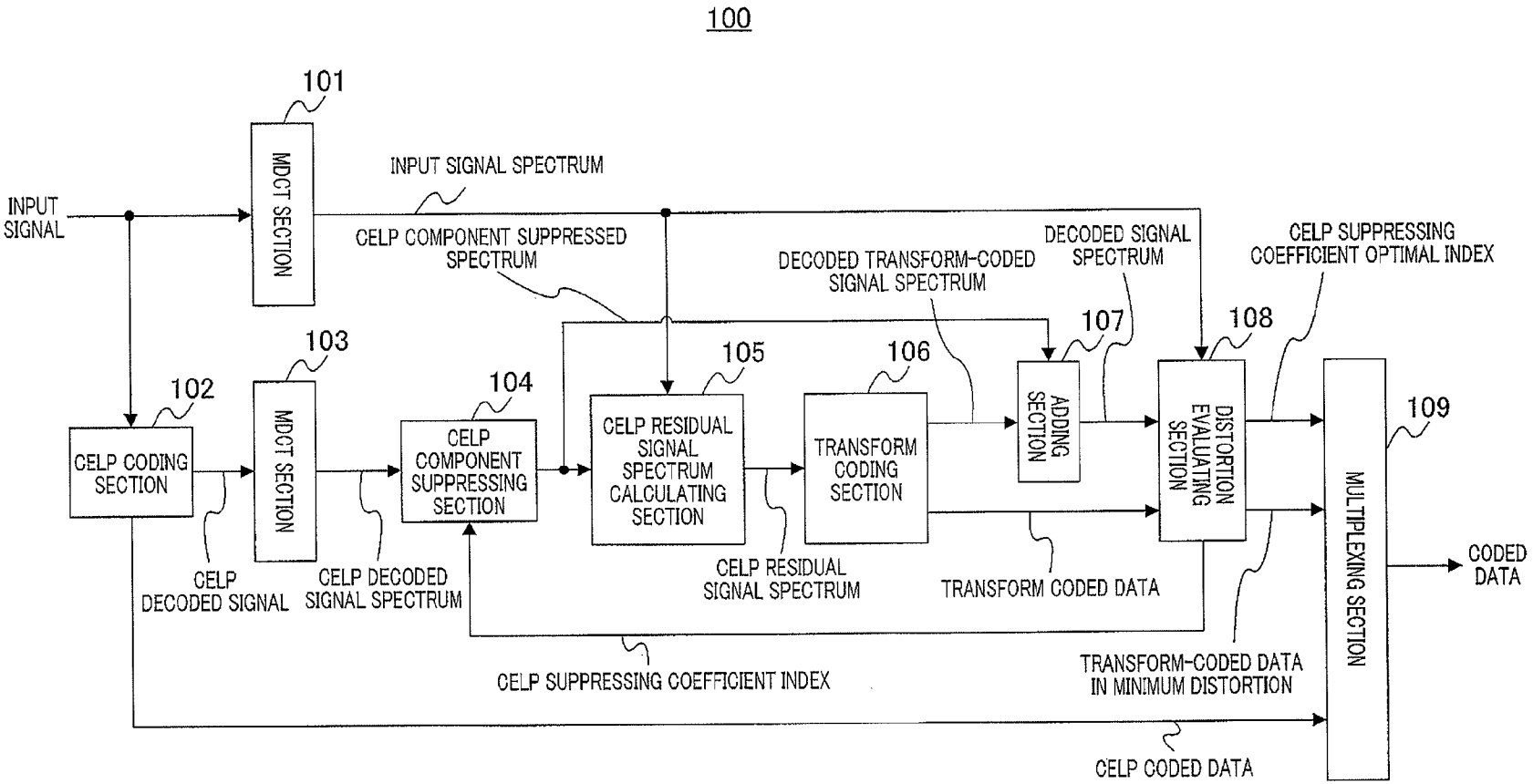
FIG. 2 is a block diagram showing a configuration of a coding apparatus according to Embodiment 1 of the present invention.

FIG. 2 is a block diagram showing a main configuration of coding apparatus 100 according to Embodiment 1 of the present invention. Coding apparatus 100 encodes an input signal such as a speech signal and a music signal through a coding method which combines CELP coding with transform coding in a layer structure and outputs coded data. As shown in FIG. 2, coding apparatus 100 includes modified discrete cosine transform (MDCT) section 101, CELP coding section 102, MDCT section 103, CELP component suppressing section 104, CELP residual signal spectrum calculating section 105, transform coding section 106, adding section 107, distortion evaluating section 108, and multiplexing section 109. Each section performs the following operations.

In coding apparatus 100 shown in FIG. 2, MDCT section 101 performs a MDCT process on an input signal to generate an input signal spectrum. MDCT section 101 then outputs the generated input signal spectrum to CELP residual signal spectrum calculating section 105 and distortion evaluating section 108.

CELP coding section 102 encodes the input signal by a CELP coding method to generate CELP coded data. CELP coding section 102 decodes (local-decodes) the generated CELP coded data to generate a CELP decoded signal. CELP coding section 102 then outputs the CELP coded data to multiplexing section 109 and outputs the CELP decoded signal to MDCT section 103.

MDCT section 103 performs a MDCT process on the CELP decoded signal inputted from CELP coding section 102 to generate a CELP decoded signal spectrum. MDCT section 103 then outputs the generated CELP decoded signal spectrum to CELP component suppressing section 104.

CELP component suppressing section 104 includes a CELP component suppressing coefficient code book which stores CELP suppressing coefficients indicating the degree (level) of CELP suppressing, in association with the level of the CELP suppressing. The CELP component suppressing coefficient code book, for example, stores four types of CELP suppressing coefficients from 1.0 representing no-suppression to 0.5 representing that the amplitude of a CELP component is reduced to half. In other words, the value of the CELP suppressing coefficient is small as the degree of the CELP suppressing is higher. Each CELP suppressing coefficient is assigned an index (a CELP suppressing coefficient index). CELP component suppressing section 104 first selects the CELP suppressing coefficient from the CELP component suppressing coefficient code book in accordance with a CELP suppressing coefficient index inputted from distortion evaluating section 108. CELP component suppressing section 104 then multiplies each frequency component of the CELP decoded signal spectrum inputted from MDCT section 103 by the selected CELP suppressing coefficient, to calculate a CELP component suppressed spectrum. CELP component suppressing section 104 then outputs the CELP component suppressed spectrum to CELP residual signal spectrum calculating section 105 and adding section 107.

CELP residual signal spectrum calculating section 105 calculates a CELP residual signal spectrum, i.e., a difference between the input signal spectrum inputted from MDCT section 101 and the CELP component suppressed spectrum inputted from CELP component suppressing section 104. To be more specific, CELP residual signal spectrum calculating section 105 acquires the CELP residual signal spectrum by subtracting the CELP component suppressed spectrum from the input signal spectrum. CELP residual signal spectrum calculating section 105 then outputs the CELP residual signal spectrum to transform coding section 106.

Transform coding section 106 encodes the CELP residual signal spectrum inputted from CELP residual signal spectrum calculating section 105 by transform coding to generate transform-coded data. Transform coding section 106 decodes (local-decodes) the generated transform-coded data to generate a decoded transform-coded signal spectrum. At that time, transform coding section 106 performs encoding so as to reduce the distortion between the CELP residual signal spectrum and the decoded transform-coded signal spectrum. Transform coding section 106, for example, performs coding so as to reduce the above distortion by generating pulses at frequencies having a large amplitude of the CELP residual signal spectrum. Transform coding section 106 then outputs the transform-coded data to distortion evaluating section 108 and outputs the decoded transform-coded signal spectrum to adding section 107.

Adding section 107 adds the CELP component suppressed spectrum inputted from CELP component suppressing section 104 and the decoded transform-coded signal spectrum inputted from transform coding section 106 to calculate a decoded signal spectrum and outputs the decoded signal spectrum to distortion evaluating section 108.

Distortion evaluating section 108 scans all indices of the CLEP suppressing coefficients stored in the CELP component suppressing coefficient code book included in CELP component suppressing section 104 and searches for a CELP suppressing coefficient index to minimize the distortion between the input signal spectrum inputted from MDCT section 101 and the decoded signal spectrum inputted from adding section 107. Distortion evaluating section 108 performs CELP suppressing using all CELP suppressing coefficients (i.e. distortion evaluating section 108 outputs CELP suppressing coefficient indices) to control CELP component suppressing section 104. Distortion evaluating section 108 then outputs a CELP suppressing coefficient index which minimizes the calculated distortion to multiplexing section 109 as a CELP suppressing coefficient optimal index and outputs transform-coded data generated using the CELP suppressing coefficient optimal index to multiplexing section 109 (transform-coded data distortion when distortion is minimum).

In coding apparatus 100 shown in FIG. 2, CELP component suppressing section 104, CELP residual signal spectrum calculating section 105, transform coding section 106, adding section 107 and distortion evaluating section 108 define a closed loop. The components forming this closed loop generate the decoded signal spectrum using all CELP suppressing coefficient indices in the CELP component suppressing code book included in CELP component suppressing section 104 and searches for a candidate (a CELP suppressing coefficient index) which minimizes distortion between the input signal spectrum and the decoded signal spectrum.

Multiplexing section 109 multiplexes the CELP coded data inputted from CELP coding section 102, the transform-coded data inputted from distortion evaluating section 108 (transform-coded data when distortion is minimized), and the CELP suppressing coefficient optimal index and transmits a multiplexed result to a decoding apparatus as coded data.

Decoding apparatus 200 will now be explained. Decoding apparatus 200 decodes the coded data transmitted from coding apparatus 100 and outputs a decoded signal.

Figure 3:
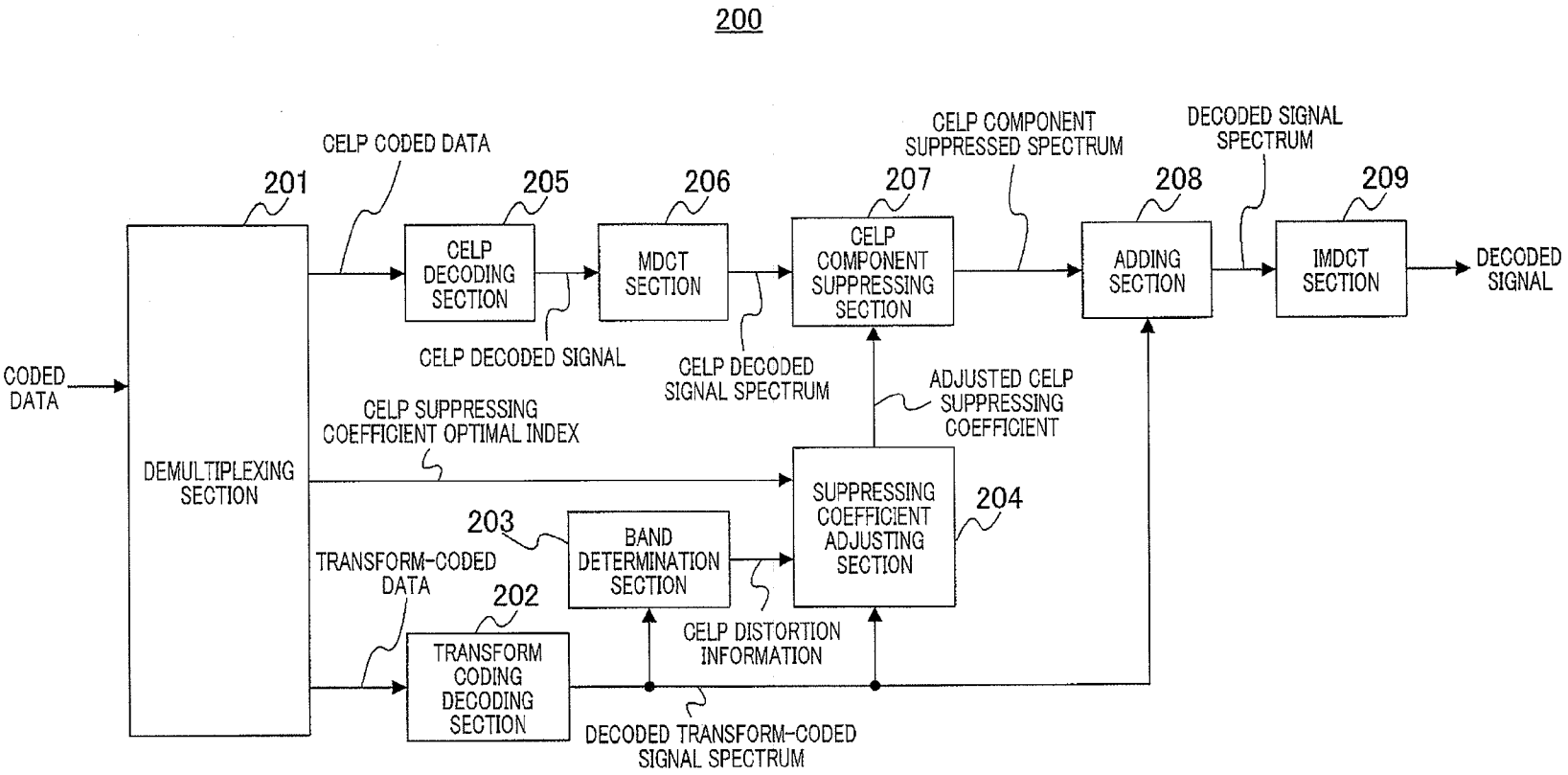
FIG. 3 is a block diagram showing a configuration of a decoding apparatus according to Embodiment 1 of the present invention.

FIG. 3 is a block diagram showing a main configuration of decoding apparatus 200. Decoding apparatus 200 includes demultiplexing section 201, transform coding decoding section 202, band determination section 203, suppressing coefficient adjusting section 204, CELP decoding section 205, MDCT section 206, CELP component suppressing section 207, adding section 208, and inverse modified discrete cosine transform (IMDCT) section 209. Each section performs the following operations.

In decoding apparatus 200 shown in FIG. 3, demultiplexing section 201 receives coded data including CELP coded data, transform-coded data, and CELP suppressing coefficient optimal index from coding apparatus 100 (FIG. 2). Demultiplexing section 201 demultiplexes the coded data into the CELP coded data, the transform-coded data, and the CELP suppressing coefficient optimal index. Demultiplexing section 201 then outputs the CELP coded data to CELP decoding section 205, outputs the transform-coded data to transform coding decoding section 202, and outputs the CELP suppressing coefficient optimal index to suppressing coefficient adjusting section 204.

Transform coding decoding section 202 decodes the transform-coded data inputted from demultiplexing section 201 to generate a spectrum of a decoded signal subjected to transform coding (hereinafter, referred to as "a decoded transform-coded signal spectrum") and outputs the decoded transform-coded signal spectrum to band determination section 203, suppressing coefficient adjusting section 204, and adding section 208.

Band determination section 203 estimates a CELP residual signal energy which is an energy of the difference between the input signal spectrum and the CELP decoded signal spectrum in every band, using the decoded transform-coded signal spectrum inputted from transform coding decoding section 202. Transform coding is performed such that a pulse is generated at a frequency in which the CELP residual signal is relatively high as compared to other frequencies. In other words, it can be supposed that the CELP residual signal energy is relatively high in a band (frequency) in which a pulse is generated in transform coding, and the CELP residual signal energy is relatively low in a band (frequency) in which no pulse is generated. Accordingly, band determination section 203 determines a band in which the pulses are generated in the decoded transform-coded signal spectrum (a band having a large CELP residual signal energy) as a band which needs CELP suppressing, and determines a band in which no pulse is generated (a band having a small CELP residual signal energy) as a band which has a less necessity of CELP suppressing, based on the estimated CELP residual signal energy for each band. In other words, band determination section 203 determines whether each of a plurality of bands obtained by dividing frequency components of the input signal is a band in which no pulse is generated (the first band) or a band in which the pulses is generated by transform coding (the second band), using the decoded transform-coded signal spectrum. Band determination section 203 then outputs a determination result to suppressing coefficient adjusting section 204 as CELP distortion information. Details of a band identifying process in band determination section 203 will be described later.

Suppressing coefficient adjusting section 204 includes a CELP component suppressing coefficient code book as with CELP component suppressing section 104 in coding apparatus 100. Suppressing coefficient adjusting section 204 adjusts the CELP suppressing coefficient for every frequency, using the CELP suppressing coefficient optimal index inputted from demultiplexing section 201, the CELP distortion information inputted from band determination section 203, and the decoded transform-coded signal spectrum inputted from transform coding decoding section 202. Suppressing coefficient adjusting section 204 then outputs the CELP suppressing coefficient adjusted for every frequency to CELP component suppressing section 207 as adjusted CELP suppressing coefficient. Details of a CELP suppressing coefficient adjusting process in suppressing coefficient adjusting section 204 will be described later.

CELP decoding section 205 decodes the CELP coded data inputted from demultiplexing section 201 and outputs the CELP decoded signal to MDCT section 206.

MDCT section 206 performs a MDCT process on the CELP decoded signal inputted from CELP decoding section 205 to generate a CELP decoded signal spectrum. MDCT section 206 then outputs the generated CELP decoded signal spectrum to CELP component suppressing section 207.

CELP component suppressing section 207 multiplies each frequency component of the CELP decoded signal spectrum inputted from MDCT section 206 by the corresponding adjusted CELP suppressing coefficient inputted from suppressing coefficient adjusting section 204, thereby calculating a CELP component suppressed spectrum in which the CELP decoded signal spectrum (CELP component) is suppressed. CELP component suppressing section 207 then outputs the calculated CELP component suppressed spectrum to adding section 208.

Adding section 208 adds the CELP component suppressed spectrum inputted from CELP component suppressing section 207 and the decoded transform-coded signal spectrum inputted from transform coding decoding section 202 to calculate a decoded signal spectrum, as with adding section 107 in coding apparatus 100. Adding section 208 then outputs the calculated decoded signal spectrum to IMDCT section 209.

IMDCT section 209 performs a MDCT process on the decoded signal spectrum inputted from adding section 208 and outputs the decoded signal.

Next, details of a band identifying process of band determination section 203 in decoding apparatus 200 (FIG. 3) and a process of adjusting CELP suppressing coefficient in suppressing coefficient adjusting section 204 will be described. Hereinafter, CELP suppressing method 1 and CELP suppressing method 2 will be described.

<CELP Suppressing Method 1>

In a method according to the present invention, band determination section 203 determines a band in which no pulse is generated in the decoded transform-coded signal spectrum inputted from transform coding decoding section 202, as a band in which CELP suppressing is alleviated on account of a low CELP residual signal energy (the first band). On the other hand, band determination section 203 determines a band in which pulses are generated in the decoded transform-coded signal spectrum inputted from transform coding decoding section 202, as a band in which CELP suppressing is performed in accordance with a CELP suppressing coefficient optimal index on account of a large CELP residual signal energy (the second band).

Band determination section 203, for example, assigns '−1' to CELP distortion information CEI[k] in a band in which no pulse is generated in the decoded transform-coded signal spectrum and assigns '0' to CELP distortion information CEI[k] in other bands (including a band in which pulses are generated) as shown in following Equation 1.

(Equation 1)

$$CEI[k] = \begin{cases} -1 & \text{if a band in which no pulse is generated} \\ 0 & \text{otherwise} \end{cases} \quad [1]$$

In Equation 1, k is an index representing a band, and for example, sixteen frequency components may constitutes one band.

Suppressing coefficient adjusting section 204 receives CELP distortion information CEI[k] from band determination section 203 and sets adjusted CELP suppressing coefficient Catt[f] in accordance with Equation 2.

(Equation 2)

$$Catt[f] = \begin{cases} 1.0 - (1.0 - CBatt[\text{cmin}]) * \alpha & \text{if } CEI[k] = -1 \\ CBatt[\text{cmin}] & \text{otherwise} \end{cases} \quad [2]$$

In Equation 2, f is an index representing a frequency included in band k shown in Equation 1. In other words, Catt[f] shown in Equation 2 is a CELP suppressing coefficient for every frequency f. CBatt represents output of the CELP suppressing coefficient code book, and cmin represents the CELP suppressing coefficient optimal index. In other words, CBatt[cmin] represents a CELP suppressing coefficient in which the CELP suppressing coefficient index is cmin in Equation 2. Parameter α is used for alleviating the degree of CELP suppressing and is set from 0.0 to 1.0. For example, parameter a is set to, approximately 0.5.

As shown in Equation 1, suppressing coefficient adjusting section 204 sets adjusted CELP suppressing coefficient Catt [f] such that output of the CELP suppressing coefficient code book is closer to 1.0 than CELP suppressing coefficient CBatt [cmin] indicated by CELP suppressing coefficient optimal index cmin (in other words, such that the output of the CELP suppressing coefficient code book is larger than CBatt[cmin]) in a band in which CELP distortion information CEI[k]=−1, i.e., a band (frequencies in the band) in which the CELP suppressing is alleviated. By this means, a control is performed such that the level of the CELP suppressing is alleviated at frequency f in band k.

On the other hand, suppressing coefficient adjusting section 204 sets, without modification, CELP suppressing coefficient CBatt[cmin] indicated by CELP suppressing coefficient optimal index cmin as adjusted CELP suppressing coefficient Catt[f], in a band in which CELP distortion information CEI[k]=0, i.e., a band (frequencies in the band) in which CELP suppressing is performed, as shown in Equation 1.

In view of the above, suppressing coefficient adjusting section 204 sets a larger CELP suppressing coefficient in a band in which no pulse is generated by transform coding (a band in which CELP suppressing is alleviated) than a CELP suppressing coefficient in a band in which pulses are generated by transform coding (a band in which CELP suppressing is performed). Accordingly, CELP component suppressing section 207 suppresses the CELP decoded signal spectrum (a frequency component of a decoded signal of CELP coded data) in a band in which no pulse is generated by transform coding (a band in which CELP suppressing is alleviated) at a lower degree than CELP suppressing in a band in which pulses are generated by transform coding (a band in which CELP suppressing is performed).

Figure 1A:
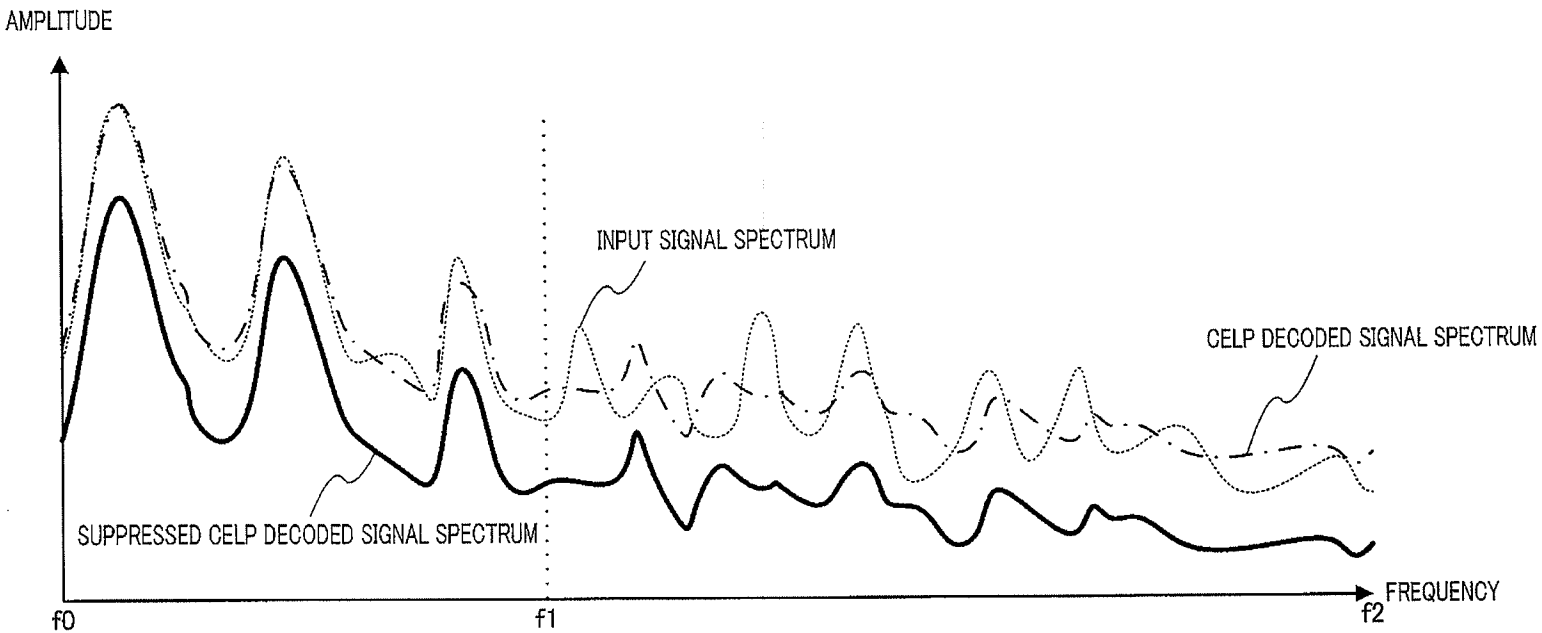
FIG. 1A is a diagram for explaining a problem of the present invention.
Figure 1B:
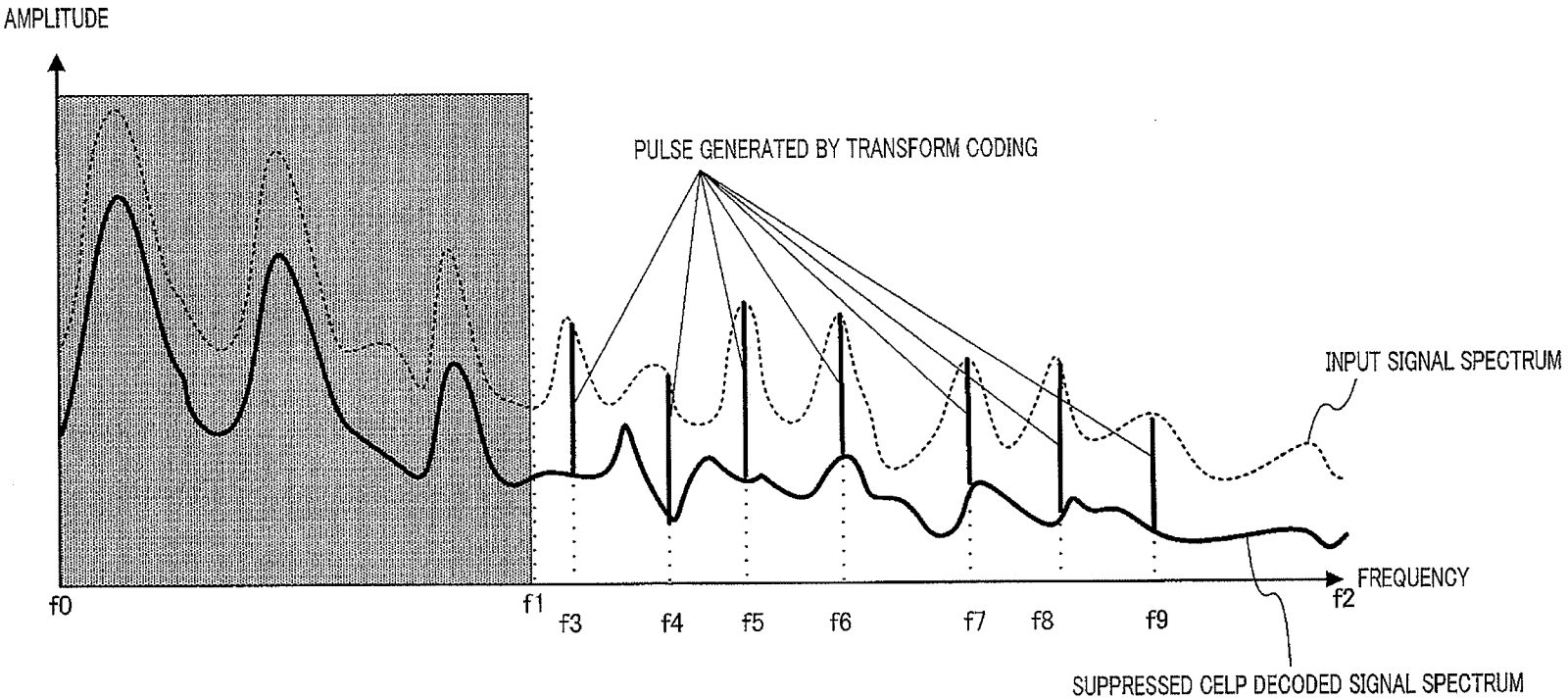
FIG. 1B illustrates a problem of the present invention.
Figure 4A:
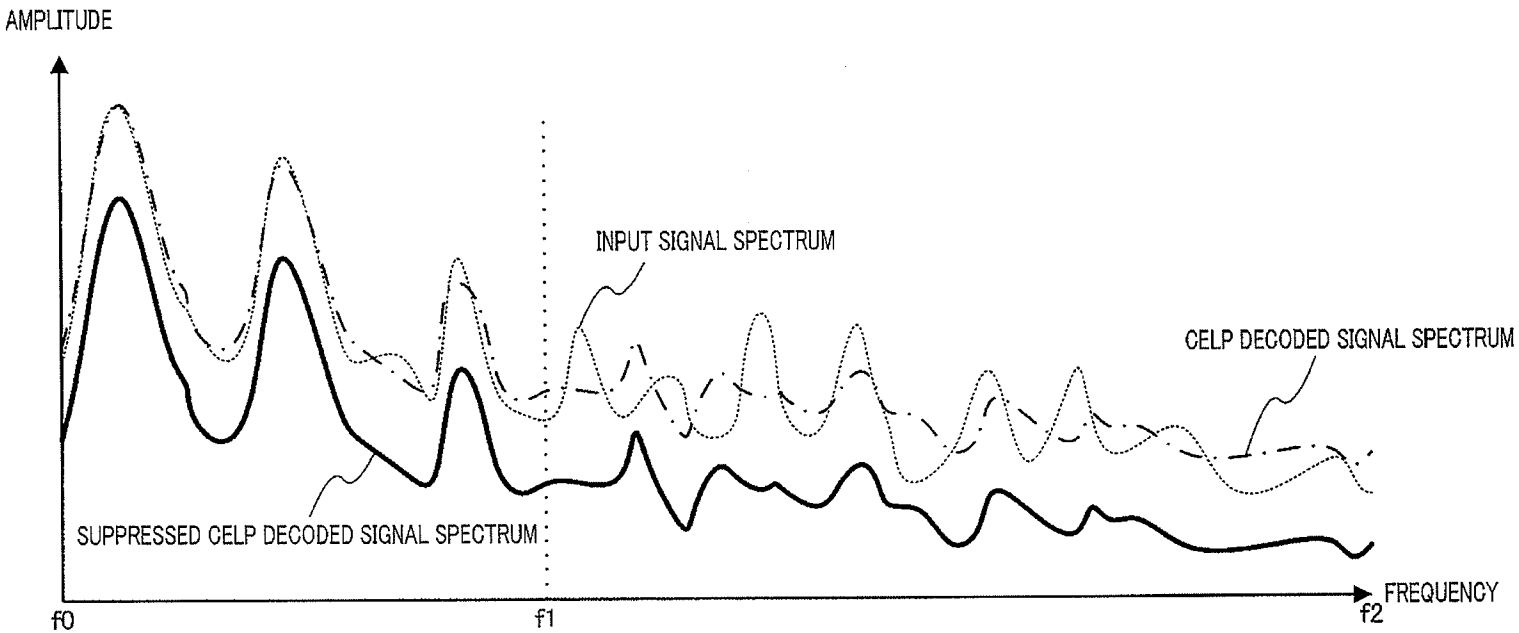
FIG. 4A illustrates a CELP suppressing process according to Embodiment 1 of the present invention.
Figure 4B:
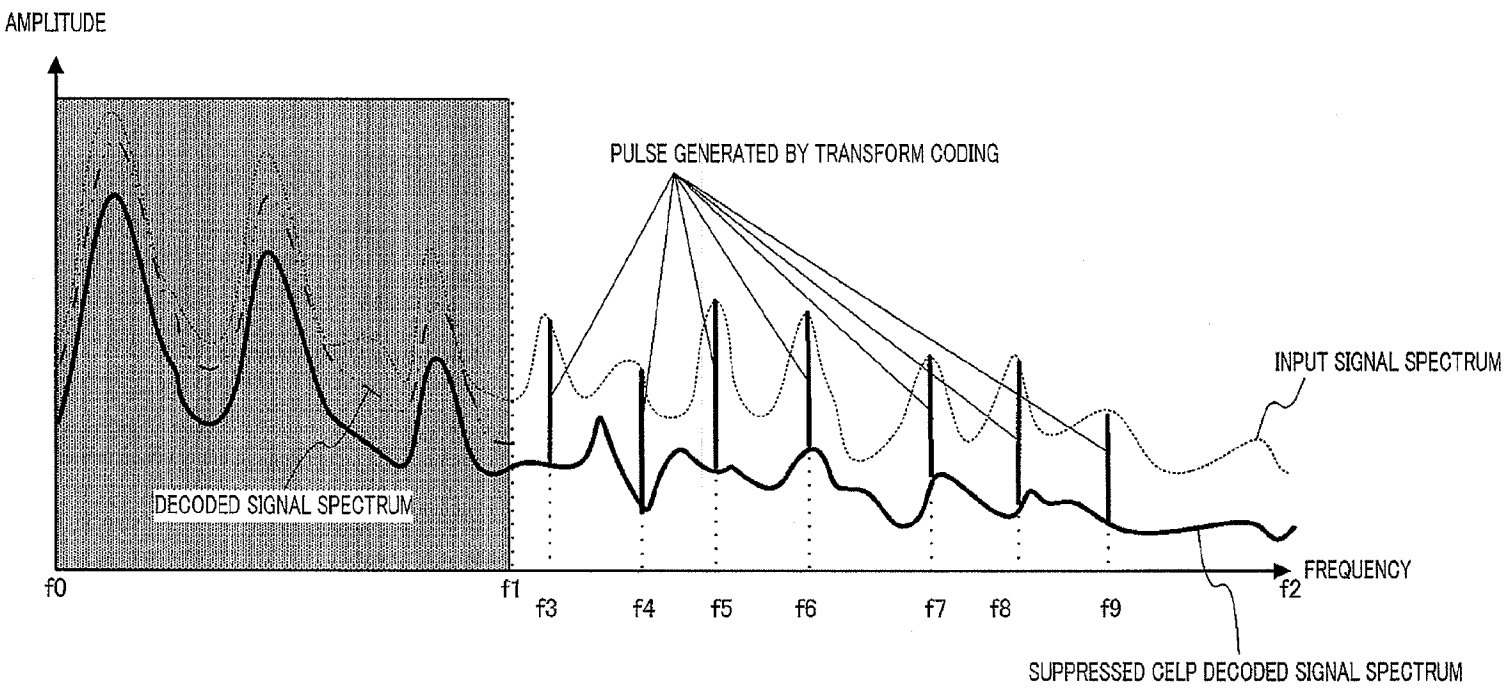
FIG. 4B illustrates a CELP suppressing process according to Embodiment 1 of the present invention.

As with FIG. 1A, FIG. 4A shows logarithmic powers (amplitudes) of an input signal spectrum in the frequency domain (a dotted line), a CELP decoded signal spectrum (a dashed line), and a suppressed CELP decoded signal spectrum (a solid line). FIG. 4B differs from FIG. 1B in that a decoded signal spectrum (a decoded speech spectrum) is added at frequency f0 to f1 (a chain double-dashed line). In other words, FIG. 4B shows logarithmic powers (amplitudes) of an input signal spectrum (a dotted line), a decoded signal spectrum at frequency f0 to f1 (a chain double-dashed line), and a suppressed CELP decoded signal spectrum (a solid line) in CELP suppressing using CELP suppressing coefficient indicated by CELP suppressing coefficient optimal index in the frequency domain.

As shown in FIG. 4A, coding apparatus 100 identifies CELP suppressing coefficient optimal index cmin by a closed loop search, and encodes a CELP residual signal spectrum which is the difference between an input signal spectrum and a suppressed CELP decoded signal spectrum by transform coding to generate transform-coded data. By this means, pulses are generated at frequencies having a high CELP residual signal energy (f3, f4, f5, f6, f7, f8, and f9 in FIG. 4B) as shown in FIG. 4B.

Band determination section 203 in decoding apparatus 200 then determines whether or not each of a plurality of bands obtained by dividing frequency components of an input signal is a band in which the degree of CELP suppressing is alleviated in CELP component suppressing section 207 (a band in which no pulse is generated by transform coding), based on a decoded transform-coded signal spectrum. As shown in FIG. 4B, no pulse is generated by transform coding in a band (f0 to f1); hence band determination section 203 determines the band (f0 to f1) as a target for alleviating CELP suppressing on account of a low CELP residual signal energy.

Band determination section 203 sets CELP distortion information CEI[k] in the band (f0 to f1) to '−1' and suppressing coefficient adjusting section 204 sets adjusted CELP suppressing coefficient Catt[f] such that output of the CELP suppressing coefficient code book is closer to 1.0 than CELP suppressing coefficient CBatt[cmin] indicated by CELP suppressing coefficient optimal index cmin (in other words, such that the output of the CELP suppressing coefficient code book is larger than CBatt[cmin]).

On the other hand, pulses are generated by transform coding in a band (f1 to f2) as shown in FIG. 4B; hence band determination section 203 determines that the band (f1 to f2) is a band in which CELP suppressing is performed on account of a large CELP residual signal energy. Band determination section 203 then sets CELP distortion information CEI[k] in the band (f1 to f2) to '0' and suppressing coefficient adjusting section 204 sets CELP suppressing coefficient CBatt[cmin] indicated by CELP suppressing coefficient optimal index cmin to adjusted CELP suppressing coefficient Catt[f].

This allows CELP component suppressing section 207 to perform CELP suppressing on the CELP decoded signal spectrum in the band (f0 to f1) at a lower degree than that in the band (f1 to f2) (CELP suppressing indicated by the CELP suppressing coefficient optimal index). Accordingly, whereas a suppressed CELP decoded signal spectrum (a solid line) is acquired in which CELP suppressing indicated by the CELP suppressing coefficient optimal index is performed in the band (f1 to f2), a decoded signal spectrum (a chain double-dashed line) is acquired in which the degree of CELP suppressing is lower than the suppressed CELP decoded signal spectrum (a solid line), in the band (f0 to f1) as shown in FIG. 4B. In other words, in the band (f0 to f1), the difference between an input signal spectrum (a dotted line) and an actual decoded signal spectrum (a chain double-dashed line) can be smaller than the difference between the input signal spectrum (a dotted line) and a suppressed CELP decoded signal spectrum (a solid line) as shown in FIG. 4B.

As described in the above, since the band (f0 to f1) shown in FIGS. 4A and 4B has a great contribution of a speech spectrum and is suitable for CELP coding, the difference (a CELP residual signal energy) between the CELP decoded signal spectrum (a dashed line) and the input signal spectrum (a dotted line) is small as shown in FIG. 4A.

In view of the above, decoding apparatus 200 determines the level of CELP suppressing in each band depending on the level of CELP residual signal energy in each band and adjusts a CELP suppressing coefficient in each band. Specifically, decoding apparatus 200 determines a band in which no pulse is generated by transform coding, as a band having relatively small CELP residual signal energy, in other words, a band having a small coding distortion due to CELP coding, and adaptively controls the CELP suppressing coefficient so as to alleviate the degree of CELP suppressing in the band.

This allows decoding apparatus 200 to prevent attenuation of a spectrum (CELP component) in a band having a great contribution to an effect of improving sound quality by CELP coding, in other words, in a band having a low CELP residual signal energy (the band (f0 to f1) in FIG. 4B). Decoding apparatus 200 then adds a CELP component in which CELP suppressing is adaptively controlled in every band and a decoded signal undergoing transform coding to acquire a decoded signal.

According to the present method, it is therefore possible to prevent deterioration of sound quality due to CELP suppressing in a band having a low CELP residual signal energy (for example, the band (f0 to f1) having a great contribution to an effect of improving sound quality in CELP coding shown in FIG. 4B) even in a coding method which combines CELP coding and transform coding in a layer structure. It is also possible to improve sound quality in transform coding by performing CELP suppressing in a band having a high CELP residual signal energy (for example, the band (f1 to f2) having a small contribution to CELP coding shown in FIG. 4B).

Moreover, according to the present method, it is possible to perform a CELP suppressing process in every band without reporting information for determining the level of a CELP residual signal energy of an input signal for each band, from a coding apparatus to a decoding apparatus.

<CELP Suppressing Method 2>

According to the present method, CELP suppressing is performed in a band in which frequencies having a large CELP residual signal energy (frequencies in which pulses are generated by transform coding) are concentrated, at a higher level compared to CELP suppressing indicated by a CELP suppressing optimal index, in addition to the CELP suppressing method described in CELP suppressing method 1.

Specifically, band determination section 203 determines a band in which no pulse is generated in the decoded transform-coded signal spectrum inputted from transform coding decoding section 202 as a band in which CELP suppressing is alleviated on account of a low CELP residual signal energy (the first band), as with CELP suppressing method 1.

Band determination section 203 determines whether a band in which pulses are generated in the decoded transform-coded signal spectrum inputted from transform coding decoding section 202 (a band determined as the second band) is a band having a high pulse density (the third band) or a band having a low pulse density (the fourth band), depending on the number of the above pulses in each band (in other words, a pulse density in each band). In a case of performing two different types of CELP suppressing depending on the number of pulses in a band in which pulses are generated, band determination section 203, for example, determines which type of the two CELP suppressing is performed in each band. Specifically, band determination section 203 determines a band in which a large number of pulses are intensively generated (the third band) as a band in which the level of CELP suppressing is enhanced on account of a high CELP residual signal energy. For example, if pulses are generated at 25% or more frequencies in a band, it may be determined that a large number of pulses are intensively generated in the band.

Band determination section 203, for example, defines CELP distortion information CEI[k] in a band in which no pulse is generated in the decoded transform-coded signal spectrum as 'A,' as shown in Equation 3. Band determination section 203 defines CELP distortion information CEI[k] in a band in which pulses are intensively generated in the decoded transform-coded signal spectrum as '1' and defines CELP distortion information CEI[k] in other bands (including bands other than bands in which pulses are intensively generated in the band in which pulses are generated) as '0,' as shown in following Equation 3.

(Equation 3)

$$CEI[k] = \begin{cases} -1 & \text{if a band in which no pulse is generated} \\ 1 & \text{else if a band in which pulses are intensively generated} \\ 0 & \text{otherwise} \end{cases} \quad [3]$$

Suppressing coefficient adjusting section 204 receives CELP distortion information CEI[k] from band determination section 203 and then sets adjusted CELP suppressing coefficient Catt[f] in accordance with Equation 4.

(Equation 4)

$$Catt[f] = \begin{cases} 1.0 - (1.0 - CBatt[\text{cmin}]) * \alpha & \text{if } CEI[k] = -1 \\ CBatt[\text{cmin}] & \text{else if } CEI[k] = 0 \\ 1.0 - (1.0 - CBatt[\text{cmin}]) * \beta & \text{else if } CEI[k] = 1 \text{ and pulse}[f] = 0 \\ CBatt[\text{cmin}] & \text{otherwise } CEI[k] = 1 \text{ and pulse}[f] = p \end{cases} \quad [4]$$

In Equation 4, f is an index representing a frequency included in band k shown in Equation 3. CBatt represents output of the CELP suppressing coefficient code book, and cmin represents the CELP suppressing coefficient optimal index. Regarding frequency f, a state in which a pulse having amplitude p generated by transform coding is represented as pulse[f]=p, and a state in which no pulse is generated by transform coding is represented as pulse[f]=0. Parameter α is used for alleviating the degree of CELP suppressing and is set from 0.0 to 1.0. For example, parameter a is set to, for example, around 0.5. Parameter β is used for enhancing the degree of CELP suppressing and is set under the conditions shown in following Equation 5. For example, CBatt[cmin] is 0.5, and β is set from 1.0 to 2.0. Parameter β is set to, for example, 1.25.

(Equation 5)

$$1.0 \le \beta \le \frac{1.0}{1.0 - CBatt[\text{cmin}]} \quad [5]$$

As shown in Equation 4, suppressing coefficient adjusting section 204 sets adjusted CELP suppressing coefficient Catt [f] such that output of the CELP suppressing coefficient code book is closer to 1.0 than CELP suppressing coefficient CBatt [cmin] indicated by CELP suppressing coefficient optimal index cmin (in other words, such that the output of the CELP suppressing coefficient code book is larger than CBatt [cmin]), in a band in which CELP distortion information CEI[k]=−1, i.e., a band (frequencies in the band) in which CELP suppressing is alleviated, as with CELP suppressing method 1. By this means, the level of CELP suppressing is controlled so as to be alleviated at frequency f in band k.

Suppressing coefficient adjusting section 204 sets adjusted CELP suppressing coefficient Catt[f] in a band in which pulses are generated by transform coding, in accordance with CELP distortion information CEI[k]. The amplitude of the pulse generated by transform coding is determined on an assumption that the pulse is subjected to CELP suppressing by CELP suppressing coefficient CBatt[cmin] indicated by CELP suppressing coefficient optimal index cmin. For this reason, suppressing coefficient adjusting section 204 may perform CELP suppressing by CELP suppressing coefficient CBatt[cmin] indicated by the CELP suppressing coefficient optimal index, in a band in which pulses are intensively generated, in other words, at frequencies (pulse[f]=p shown in Equation 4) in which the above pulses are generated in a band which needs to enhance the degree of CELP suppressing (CEI[k]=1).

Specifically, suppressing coefficient adjusting section 204 sets, without modification, CELP suppressing coefficient CBatt[cmin] indicated by CELP suppressing coefficient optimal index cmin as adjusted CELP suppressing coefficient Catt[f], in a band in which CELP distortion information CEI [k]=0, i.e., a band in which the above pulses are not intensively generated (frequencies in the band) in a band in which pulses are generated by transform coding, as shown in Equation 4.

On the other hand, suppressing coefficient adjusting section 204 sets adjusted CELP suppressing coefficient Catt[f], such that output of the CELP suppressing coefficient code book is closer to 0.0 than CELP suppressing coefficient CBatt [cmin] indicated by CELP suppressing coefficient optimal index cmin (in other words, such that the output of the CELP suppressing coefficient code book is smaller than CBatt [cmin]), in a case of CELP distortion information CEI[k]=1 and pulse[f]=0, i.e., in a case of a frequency in which no pulse is generated in a band in which pulses are intensively generated by transform coding, as shown in Equation 4. The level of CELP suppressing is therefore controlled so as to be enhanced at frequency f in band k.

Suppressing coefficient adjusting section 204 sets, without modification, CELP suppressing coefficient CBatt[cmin] indicated by CELP suppressing coefficient optimal index cmin as adjusted CELP suppressing coefficient Catt[f], in a case of CELP distortion information CEI[k]=1 and pulse[f]=p, i.e., in a case of a frequency in which a pulse is generated in a band in which pulses are intensively generated by transform coding, as shown in Equation 4.

In this way, suppressing coefficient adjusting section 204 reduces a CELP suppressing coefficient in a band having a high density of pulses generated by transform coding (a band in which the degree of CELP suppressing is enhanced) at a lower level than a CELP suppressing coefficient in a band having a low density of pulses generated by transform coding (the CELP suppressing coefficient at the CELP suppressing coefficient optimal index indicated from coding apparatus 100). Suppressing coefficient adjusting section 204 increases a CELP suppressing coefficient in a band in which no pulse is generated by transform coding, at a higher level than a CELP suppressing coefficient in a band in which pulses are generated by transform coding (a band having a low pulse density), as with CELP suppressing method 1.

CELP component suppressing section 207 then suppresses the CELP decoded signal spectrum (a frequency component of a decoded signal of the CELP coded data) in a band having a high density of pulses generated by transform coding at a higher degree than CELP suppressing in a band having a low density of pulses generated by transform coding. CELP component suppressing section 207 suppresses the CELP decoded signal spectrum at frequencies in which pulses are generated in a band having a high density of pulses generated by transform coding at the same degree as the degree of CELP suppressing in a band having a low density of pulses. CELP component suppressing section 207 suppresses the CELP decoded signal spectrum in a band in which no pulse is generated by transform coding, at a lower degree than the degree of CELP suppressing in a band in which pulses are generated by transform coding (a band having a low pulse density), as with CELP suppressing method 1.

This can reduce the difference between the decoded signal spectrum (a chain double-dashed line) and the input signal spectrum (a dotted line) at a lower level than the difference between the suppressed CELP decoded signal spectrum (a solid line) and the input signal spectrum (a dotted line), in a band in which no pulse is generated in the decoded transform-coded signal spectrum (for example, the band (f0 to f1) shown in FIG. 4B), as with CELP suppressing method 1. In other words, decoding apparatus 200 can alleviate the CELP suppressing to thereby prevent deterioration of sound quality due to CELP suppressing, in a band in which no pulse is generated by transform coding (a band having a great contribution to an effect of improving sound quality in CELP coding).

Band determination section 203 determines that a band in which pulses are intensively generated in the decoded transform-coded signal spectrum (for example, the band (f1 to f2) shown in FIG. 4B) is a band in which CELP suppressing is further enhanced on account of a high CELP residual signal energy. Suppressing coefficient adjusting section 204, for example, sets CELP suppressing coefficient CBatt[cmin] indicated by CELP suppressing coefficient optimal index cmin to adjusted CELP suppressing coefficient Catt[f] at frequencies in which pulses are generated by transform coding (frequency f where pulse[f]=p, namely, f3, f4, f5, f6, f7, f8, and f9 shown in FIG. 4B) in the band (f1 to f2) shown in FIG. 4B. On the other hand, suppressing coefficient adjusting section 204 sets adjusted CELP suppressing coefficient Catt[f] at frequencies (pulse[f]=0) in which no pulse is generated by transform coding in the band (f1 to f2) shown in FIG. 4B such that output of the CELP suppressing coefficient code book is closer to 0.0 than CELP suppressing coefficient CBatt[cmin] indicated by CELP suppressing coefficient optimal index cmin (in other words, such that the output of the CELP suppressing coefficient code book is smaller than CBatt[cmin]).

By this means, distortion between the decoded signal spectrum (an added result of the suppressed CELP decoded signal spectrum and the decoded transform-coded signal spectrum) and the input spectrum remains small at frequencies in which pulses are generated in the band (f1 to f2) in which pulses are intensively generated by transform coding.

On the other hand, CELP suppressing is performed at a higher degree than the degree of CELP suppressing indicated by CELP suppressing coefficient optimal index cmin at frequencies in which no pulse is generated in the band (f1 to f2). The suppressed CELP decoded signal spectrum is therefore further decreased (not shown). Accordingly, compared to a perceptually important peak frequency component having a small distortion (a frequency component in which pulses are generated by transform coding), other frequency components are further suppressed, and therefore a noise floor can be further reduced in the band (f1 to f2) shown in FIG. 4B.

Accordingly, it is possible to prevent deterioration of sound quality due to CELP suppressing in a band having a low CELP residual signal energy (for example, the band (f0 to f1) having a great contribution to an effect of improving sound quality in CELP coding shown in FIG. 4B) even in a coding method which combines CELP coding and transform coding in a layer structure, as with CELP suppressing method 1. Furthermore, according to the present method, it is possible to acquire a decoded signal having very clear sound quality without noise by attenuating a noise floor in a band having a high CELP residual signal energy (for example, the band (f1 to f2) in which pulses are intensively generated by transform coding).

CELP suppressing methods 1 and 2 have been described above.

In view of the above, according to the present embodiment, the decoding apparatus controls the level of CELP suppressing (a CELP suppressing coefficient) depending on the level of a CELP residual signal energy in every band. The control alleviates the CELP suppressing in a band having a low CELP residual signal energy, thereby making it possible to maintain the degree of contribution to an effect of improving sound quality in CELP coding. CELP suppressing in a band having a high CELP residual signal energy enables transform coding to improve high sound quality. According to the present embodiment, it is possible to adaptively control CELP suppressing in every band by determining the degree of CELP coding contribution based on the result of transform coding in every band, thereby decoding a speech/music signal with high sound quality, even when through a coding method which combines CELP coding and transform coding in a layer structure.

Embodiment 2

Figure 5:
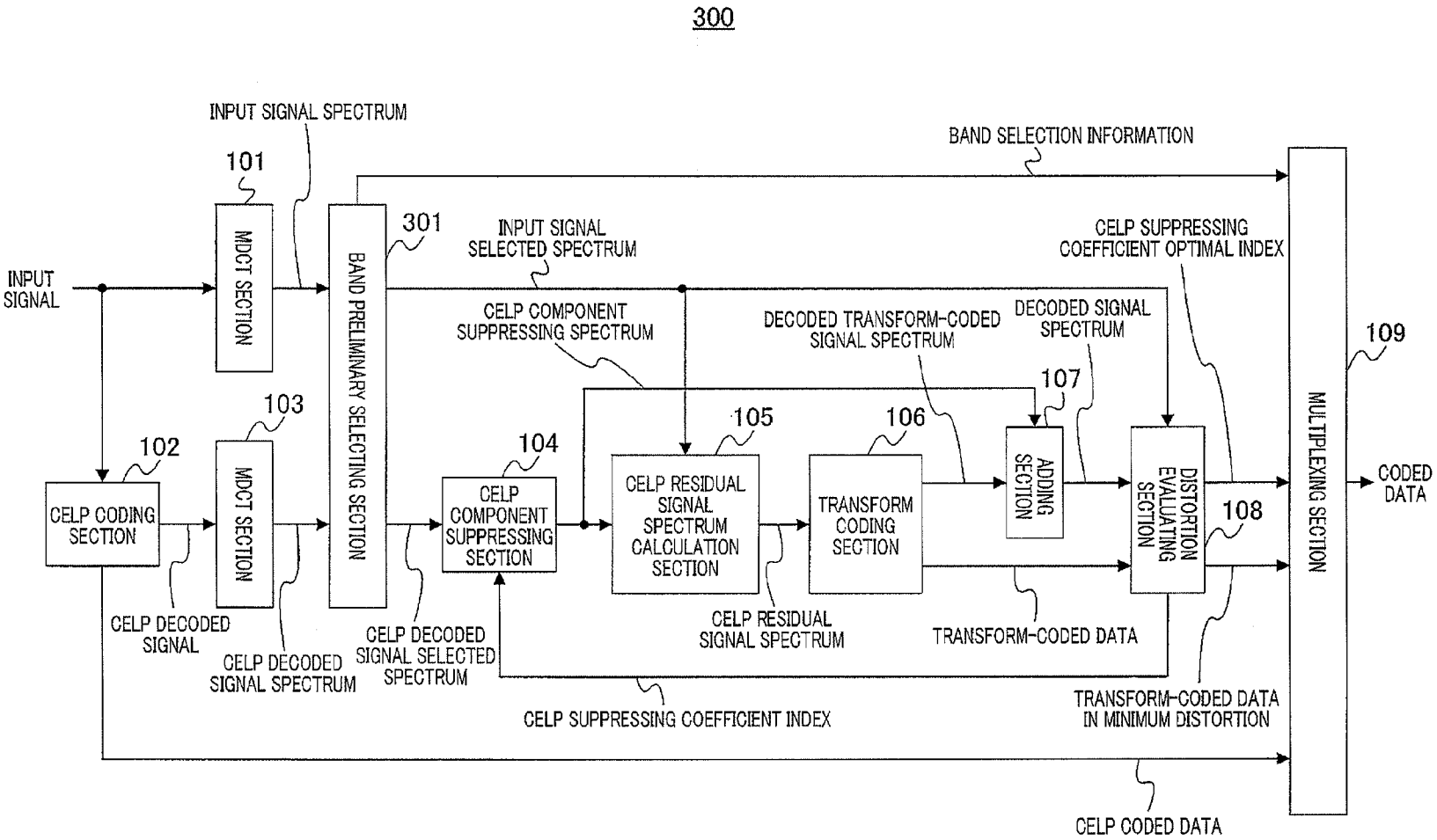
FIG. 5 is a block diagram showing a configuration of a coding apparatus according to Embodiment 2 of the present invention.

FIG. 5 is a block diagram showing a main configuration of coding apparatus 300 according to Embodiment 2 of the present invention. In FIG. 5, the same components as in Embodiment 1 (FIG. 2) are assigned the same reference numerals and descriptions will be omitted. Coding apparatus 300 shown in FIG. 5 differs from coding apparatus 100 shown in FIG. 2 in that band preliminary selecting section 301 is added to coding apparatus 100. The present embodiment differs from Embodiment 1 in that CELP component suppressing section 104, CELP residual signal spectrum calculating section 105, transform coding section 106, adding section 107, and distortion evaluating section 108 in coding apparatus 300 shown in FIG. 5 receive only a signal in a band selected in band preliminary selecting section 301 among signals treated in coding apparatus 100 shown in FIG. 2. The operations of each component themselves, however, do not change. The present embodiment differs from Embodiment 1 in that multiplexing section 109 further receives band selection information outputted from band preliminary selecting section 301. Hereinafter, components and operations which are different from Embodiment 1 (FIG. 2) will be described.

In coding apparatus 300 shown in FIG. 5, band preliminary selecting section 301 receives an input signal spectrum from MDCT section 101 and receives a CELP decoded signal spectrum from MDCT section 103. Band preliminary selecting section 301 distinguishes between bands having a high CELP residual signal energy and the other bands in order to narrow a target band for transform coding, in other words, a target band for CELP suppressing among a plurality of bands obtained by dividing the input signal spectrum (a frequency component of the input signal). Band preliminary selecting section 301 then selects a preset number of bands having a higher CELP residual signal energy among a plurality of bands obtained by dividing the input signal spectrum, as a target band for transform coding.

For example, a case will be described where one frame having 320 frequency components is divided into sixteen subbands (twenty components for each subband) at the same interval. The sixteen subbands are assigned subband numbers from one to sixteen in ascending order from a lower band. At this time, band preliminary selecting section 301, for example, selects eight subbands of subband numbers 1, 2, 3, 4, 5, 13, 14, and 15 (160 components) as target subbands for transform coding in descending order of CELP residual signal energy among the sixteen subbands. Hereinafter, the subbands selected as target subbands for transform coding are referred to as a preliminarily selected subband.

Band preliminary selecting section 301 then reconstitutes frequency components (160 components) which constitute the preliminarily selected subbands (for example, eight subbands of subband numbers 1, 2, 3, 4, 5, 13, 14, and 15) in the input signal spectrum as an input signal selected spectrum, and outputs the input signal selected spectrum to CELP residual signal spectrum calculating section 105 and distortion evaluating section 108. Band preliminary selecting section 301 reconstitutes frequency components which constitute the preliminarily selected subband in the CELP decoded signal spectrum as a CELP decoded signal selected spectrum, as with the input signal spectrum, and outputs the CELP decoded signal selected spectrum to CELP component suppressing section 104.

Band preliminary selecting section 301 also generates band selection information indicating the preliminarily selected subbands (eight subbands of subband number 1, 2, 3, 4, 5, 13, 14, and 15) and outputs the band selection information to multiplexing section 109.

Transform coding section 106 in coding apparatus 300 then performs transform coding on only a CELP residual signal spectrum of the preliminarily selected subband (selected band) to acquire transform-coded data.

The above band selection permits coding apparatus 300 to reduce the number of candidate frequency positions (targets for transform coding) in which pulses are generated by transform coding. It is noted that the transform coding is performed so as to reduce a coding distortion by generating pulses at frequencies having high CELP residual signal energies, as described above. In contrast, bands having higher CELP residual signal energies are selected as preliminarily selected subbands among all bands of the input signal. In other words, coding apparatus 300 performs transform coding on a band selected as a target for transform coding, thereby enabling a decrease in transform-coded data without decreasing the number of pulses actually generated by transform coding.

Figure 6:
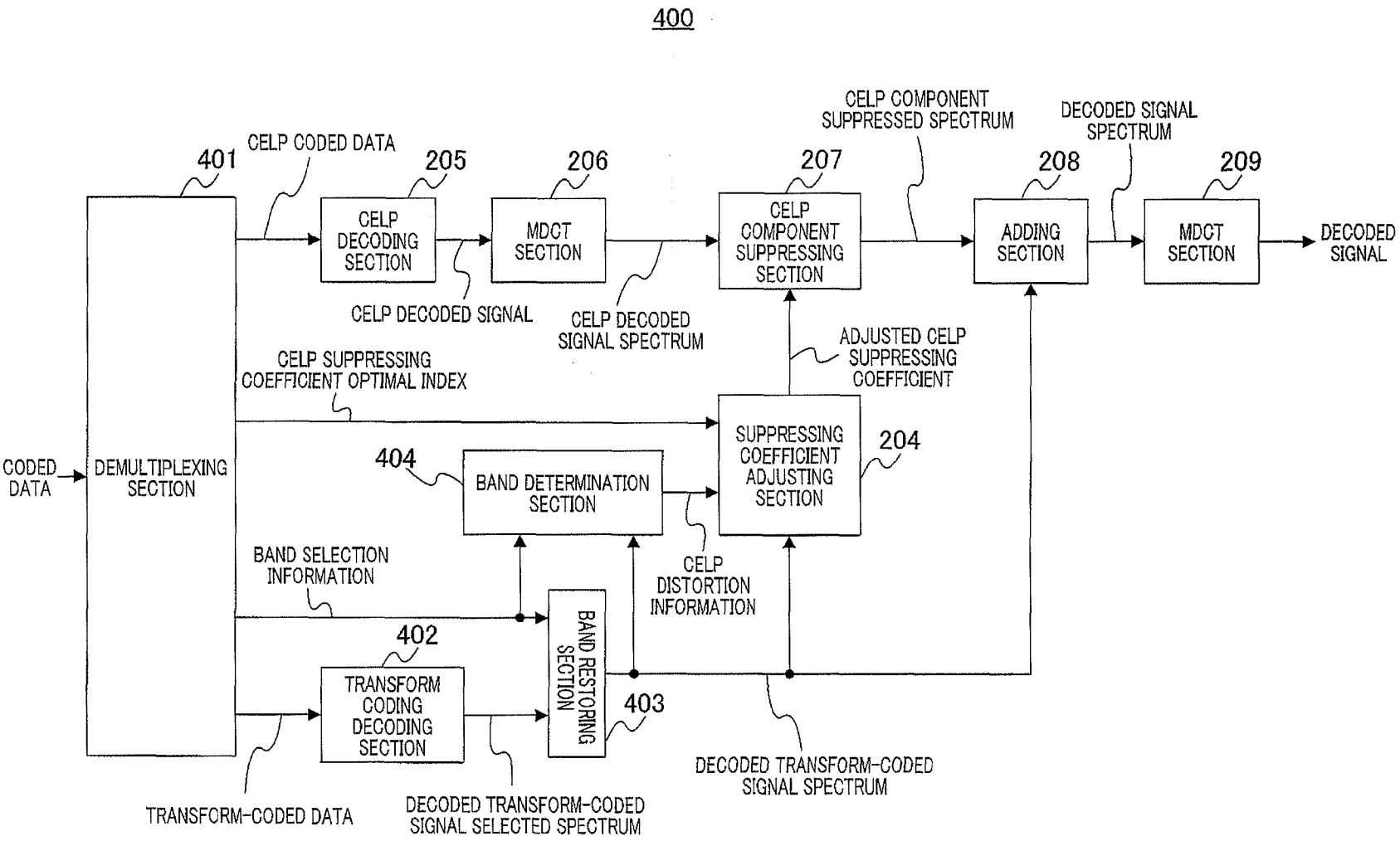
FIG. 6 is a block diagram showing a configuration of a decoding apparatus according to Embodiment 2 of the present invention.

FIG. 6 is a block diagram showing a main configuration of decoding apparatus 400 according to Embodiment 2 of the present invention. In FIG. 6, the same components as in Embodiment 1 (FIG. 3) are assigned the same reference numerals, and descriptions will be omitted. Decoding apparatus 400 shown in FIG. 6 differs from decoding apparatus 200 shown in FIG. 3 in that band restoring section 403 is added to decoding apparatus 200. Hereinafter, components and operations which are different from Embodiment 1 (FIG. 3) will be described.

In decoding apparatus 400 shown in FIG. 6, demultiplexing section 401 demultiplexes the coded data transmitted from coding apparatus 300 (FIG. 5) into CELP coded data, transform-coded data, a CELP suppressing coefficient optimal index, and band selection information. Demultiplexing section 401 then outputs the CELP coded data to CELP decoding section 205, outputs the transform-coded data to transform coding decoding section 402, outputs the CELP suppressing coefficient optimal index to suppressing coefficient adjusting section 204, and outputs the band selection information to band restoring section 403 and band determination section 404.

Transform coding decoding section 402 decodes the transform-coded data inputted from demultiplexing section 401 to generate decoded transform-coded signal selected spectrum and outputs the decoded transform-coded signal selected spectrum to band restoring section 403. The decoded transform-coded signal selected spectrum is acquired by decoding a signal obtained by connecting transform-coded data in the preliminarily selected subband indicated by the band selection information.

Band restoring section 403 arranges, into an original band, the decoded transform-coded signal selected spectrum inputted from transform coding decoding section 402, based on the band selection information inputted from demultiplexing section 401. Specifically, band restoring section 403 arranges signals of the preliminarily selected subbands which constitute the decoded transform-coded signal selected spectrum at frequency positions of the preliminarily selected subbands indicated by the band selection information. Band restoring section 403 assigner zero to signals in subbands not included in the band selection information (subbands other than the preliminarily selected subbands). This restores a decoded transform-coded signal spectrum in all bands. Band restoring section 403 then outputs the restored decoded transform-coded signal spectrum to band determination section 404, suppressing coefficient adjusting section 204, and adding section 208.

Band determination section 404 determines whether a subband indicated by the band selection information inputted from demultiplexing section 401 (the preliminarily selected subband) is a band in which no pulse is generated (the first band) or a band in which pulses are generated by transform coding (the second band), using the decoded transform-coded signal spectrum inputted from band restoring section 403, as with band determination section 203 in Embodiment 1. In other words, band determination section 404 can identify subbands in which pulses may be generated by transform coding, with reference to band selection information. Band determination section 404 determines a band in which pulses are generated in the preliminarily selected subbands (a band having a high CELP residual signal energy) as a band which needs CELP suppressing and determines a band in which no pulse is generated in the preliminarily selected subbands (a band having a low CELP residual signal energy) as a band which has a less necessity of the CELP suppressing, in the decoded transform-coded signal spectrum. In other words, band determination section 404 determines whether to perform CELP suppressing in only preliminarily selected subbands indicated by the band selection information.

Accordingly, coding apparatus 300 limits bands to be targets for transform coding before a transform coding process. Coding apparatus 300 then performs transform coding on only the bands to be the targets for transform coding. Specifically, coding apparatus 300 selects a preset number of bands (preliminarily selected subbands) having higher CELP residual signal energies in bands of an input signal, and performs transform coding on only a CELP residual signal spectrum in the selected bands to acquire transform-coded data.

Coding apparatus 300 searches only the bands to be the targets for transform coding, for an optimal CELP suppressing coefficient.

Although coding apparatus 300 needs to report band selection information to decoding apparatus 400, candidate frequencies are limited in which pulses are generated by transform coding, thereby enabling a reduction in a bit rate for transform coding. Coding apparatus 300 searches for an optimal CELP suppressing coefficient in a limited band which has a higher CELP residual signal energy, and therefore does not perform excessive CELP suppressing on a band which originally has a lower CELP residual energy. In other words, coding apparatus 300 does not perform CELP suppressing on subbands other than preliminarily selected subbands, thereby making it possible to prevent a deterioration of sound quality due to the CELP suppressing (a negative effect of CELP suppressing).

Decoding apparatus 400 performs a decoding process and a CELP suppressing on transform-coded data in only preliminarily selected subbands indicated by band selection information. In other words, decoding apparatus 400 performs CELP suppressing in the preliminarily selected subband of a CELP decoded signal spectrum, using a CELP suppressing coefficient searched from the preliminarily selected subband. On the other hand, decoding apparatus 400 does not perform CLEP suppressing in subbands other than the preliminarily selected subbands of the CELP decoded signal spectrum (in other words, subbands having a low CELP residual signal energy). Alternatively, decoding apparatus 400 may perform CELP suppressing in subbands other than the preliminarily selected subband of the CELP decoded signal spectrum, at a lower degree than the degree of CELP suppressing in the preliminarily selected subband.

Accordingly, decoding apparatus 400 can significantly increase the effect of an improvement of sound quality by transform coding in a band in which pulses are generated by transform coding (preliminarily selected subbands), and maintain the effect of an improvement of sound quality by CELP coding in a band other than the band in which pulses are generated (subbands other than the preliminarily selected subbands).

Decoding apparatus 400 controls the level of CELP suppressing depending on the level of the CELP residual signal energy in every band in CELP suppressing, as with Embodiment 1. Accordingly, CELP suppressing is alleviated in a band having a lower CELP residual signal energy, thereby making it possible to maintain the degree of contribution to an improvement of sound quality by CELP coding.

According to the present embodiment, it is possible to adaptively control CELP suppressing in every band by determining the degree of contribution of CELP coding based on the result of transform coding in every band, even in a case of using a coding method which combines CELP coding and transform coding in a layer structure, as with Embodiment 1. Moreover, the present embodiment limits a band undergoing transform coding, in other words, a band (subband) undergoing CELP suppressing. This can reduce a bit rate for transform coding and eliminate CELP suppressing on a band which originally has a small CELP residual signal energy, thereby improving sound quality.

In the present embodiment, a case will be described where CELP suppressing is not performed in subbands other than the preliminarily selected subbands. Alternatively, the coding apparatus and the decoding apparatus may search for the CELP suppressing coefficient in the preliminarily selected subbands and subbands other than the preliminarily selected subbands, and may also search for the CELP suppressing coefficient in only subbands other than the preliminarily selected subbands. Still alternatively, the coding apparatus and the decoding apparatus may perform CELP suppressing in the subbands other than the preliminarily selected subbands, using a CELP suppressing coefficient larger than the CELP suppressing coefficient determined in the preliminarily selected subbands (i.e. CELP suppressing at a lower degree than the degree of CELP suppressing in the preliminarily selected subbands).

Embodiments of the present invention have been described above.

In the above embodiments, a case has been described where the band determination section of the decoding apparatus divides the spectrum of the input signal (frequency components) into bands having equal intervals, each band including twenty frequency components, but may divide the spectrum of the input signal by inconstant intervals. The interval of the frequency components forming each band may be longer in a higher band, for example. Alternatively, frequency components between pulses generated by the transform coding may be defined as one band, and one band may be centered around the pulses generated by the transform coding.

In the above embodiments, an example case has been described where the suppressing coefficient adjusting section in the decoding apparatus uses a constant (adjusted CELP suppressing coefficient Catt[f] shown in Equation 2 or Equation 4) in order to enhance or alleviate the degree (level) of CELP suppressing determined in the closed loop search in the coding apparatus. A method of alleviating and enhancing the degree (level) of CELP suppressing is not limited to a case of using the constant.

The level of the constant to enhance or alleviate the CELP suppressing coefficient may include 1.0 (a case where the CELP suppressing is not performed). In the above embodiments, a case of using the constant (Equation 2 and Equation 4) as the CELP suppressing coefficient has been described, but the CELP suppressing coefficient may be determined by a dynamic control. An upper limit of a change in the CELP suppressing coefficient may be set not so as to exceed a certain variation from CELP suppressing coefficient used in the past, or the change in the CELP suppressing coefficient may be reduced not so as to exceed a range obtained by adding a predetermined constant (or subtracted) to the CELP suppressing coefficient used in the past, for example.

In the above embodiments, a CELP suppressing coefficient in one band need not be fixed, and may be dynamically controlled depending on a distance from a pulse generated by transform coding, for example.

In the above embodiments, a case of multiplying the amplitude of a CELP decoded signal spectrum by an attenuation coefficient (a CELP suppressing coefficient) has been described as a CELP suppressing method, but the CELP suppressing method is not limited thereto. A CELP suppressing method may be performed using a moving average process in the frequency domain, for example. Generally, when a CELP suppressing coefficient varies in every frame, musical noise may occur. An energy in a band subjected to CELP suppressing does not significantly vary as compared to an energy of a CELP decoded signal spectrum by means of the moving average process in the frequency domain in CELP suppressing method, so that the musical noise is unlikely to occur.

The above embodiments employ CELP coding as an example of coding suitable for a speech signal, but the present invention can be implemented using, for example, ADPCM (Adaptive Differential Pulse Code Modulation), APC (Adaptive Prediction Coding), ATC (Adaptive Transform Coding), and TCX (Transform Coded Excitation), and the same effect can be acquired.

A case has been described where the transform coding is employed as an example of coding suitable for a music signal in the above embodiments, but a method may be also applicable which can efficiently encode a residual signal between an input signal and a decoded signal in a coding method suitable for a speech signal in the frequency domain. Such a method includes FPC (Factorial Pulse Coding) and AVQ (Algebraic Vector Quantization), and the same effect can be acquired.

In the above embodiments, decoding apparatus 200 and 400 receive coded data outputted from coding apparatus 100 and 300, but the present invention is not limited thereto. In other words, decoding apparatus 200 and 400 can decode any coded data outputted from a coding apparatus capable of generating coded data including coded data necessary for decoding, instead of coded data generated in the configuration of coding apparatus 100 and 300.

Although a case has been described with each embodiment as an example where the present invention is implemented with hardware, the present invention can be implemented with software in collaboration with hardware.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be regenerated is also possible.

Further, if integrated circuit technology comes out to replace LSI's as a result of the advancement of semiconductor technology or a derivative other technology, it is naturally also possible to carry out function block integration through this technology. Application of biotechnology is also possible.

The disclosure of Japanese Patent Application No. 2010-134127, filed on Jun. 11, 2010, including the specification, drawings and abstract, is incorporated herein by reference in its entirety.

INDUSTRIAL APPLICABILITY

A coding apparatus, a decoding apparatus, and coding and decoding methods according to the present invention can improve quality of a decoded signal, and may be applicable to a packet communication system, a mobile communication system, and so forth.

REFERENCE SIGNS LIST

100, 300 Coding apparatus
200, 400 Decoding apparatus
101, 103, 206 MDCT section
102 CELP coding section
104, 207 CELP component suppressing section
105 CELP residual signal spectrum calculating section
106 Transform coding section
107, 208 Adding section
108 Distortion evaluating section
109 Multiplexing section
201, 401 Demultiplexing section
202, 402 Transform coding decoding section
203, 404 Band determination section
204 Suppressing coefficient adjusting section
205 CELP decoding section
209 IMDCT section
301 Band preliminary selecting section
403 Band restoring section

The invention claimed is:

1. A decoding apparatus that receives and decodes CELP coded data generated through CELP coding and transform coded data generated through transform coding, the apparatus comprising:

a memory that stores instructions;

a processor that executes the instructions;

a CELP decoder that decodes the CELP coded data;

a first transformer that performs a modified discrete cosine transform on the decoded CELP coded data, to generate a first spectrum;

a transform coding decoder that decodes the transform coded data to generate a second spectrum;

an identification section that determines that one of a plurality of bands obtained by dividing frequency components of the second spectrum is a first band in which no pulse is generated by the transform coding and another of the plurality of bands is a second band next to the first band in which pulses are generated by the transform coding, using the second spectrum, and identifies degrees of a CELP suppression of an amplitude of the first spectrum for the first band and the second band based on the determination result;

a suppressor that suppresses an amplitude of the first band of the first spectrum and an amplitude of the second band of the first spectrum, based on the identified degrees of the CELP suppression of the amplitude of the first spectrum, and outputs a CELP component suppressed spectrum, an adder that adds the CELP component suppressed spectrum and the second spectrum to calculate a decoded signal spectrum; and a second transformer that performs an inverse modified discrete cosine transform on the decoded signal spectrum, and outputs a decoded signal that is a speech/audio signal, wherein the degree of the suppression in the first band is a lower level than that in the second band, the identification section further determines whether a band determined to be the second band among the plurality of bands is a third band having a high pulse density or a fourth band having a low pulse density, the suppressor suppresses the first spectrum in the third band at a degree equal to or higher than suppression in the fourth band and suppresses the first spectrum in the first band at a degree lower than suppression in the fourth band, the suppressor suppresses the first spectrum at a frequency in which the pulses are not generated in the third band, at a degree higher than suppression in the fourth band, suppresses the first spectrum at a frequency in which the pulses are generated in the third band at the same degree as suppression in the fourth band, and at least one of the CELP decoder, the first transformer, the transform coding decoder, the identification section, the suppressor, the adder and the second transformer is implemented by the processor.

2. The decoding apparatus according to claim 1, further comprising:

an adjusting section that adjusts a suppressing coefficient indicating the degree of suppression to the first spectrum, a value of the suppressing coefficient decreasing with an increase in the degree of the suppression, and adjusts the suppressing coefficient in the first band to a higher level than the suppressing coefficient in the second band, wherein the suppressing section suppresses the first spectrum by multiplying the first spectrum by the suppressing coefficient.

3. The decoding apparatus according to claim 1 further comprising:

an adjusting section that adjusts a suppressing coefficient indicating the degree of suppression to the first spectrum, a value of the suppressing coefficient decreasing with an increase in the degree of the suppressing, and adjusts the suppressing coefficient in the third band to a lower level than the suppressing coefficient in the fourth band and adjusts the suppressing coefficient in the first band to a higher level than the suppressing coefficient in the fourth band, wherein the suppressing section suppresses the first spectrum by multiplying the first spectrum by the suppressing coefficient.

4. The decoding apparatus according to claim 1, wherein:

the transform coding decoder comprises a third decoder that decodes the transform coded data to generate a selected spectrum, and the decoding apparatus further comprises a band restoring section that receives band selection information indicating a band subjected to the transform coding upon the generation of the transform coded data and generates the second spectrum using the band selection information and the selected spectrum; and the identification section identifies the first band further using the band selection information.

5. A decoding method that receives and decodes CELP coded data generated through CELP coding and transform coded data generated through transform coding, the method comprising:

decoding the CELP coded data;

performing a modified discrete cosine transform on the decoded CELP coded data, to generate a first spectrum;

decoding the transform coded data to generate a second spectrum;

determining that one of a plurality of bands obtained by dividing frequency components of the second spectrum is a first band in which no pulse is generated by the transform coding and another of the plurality of bands is a second band next to the first band in which pulses are generated by the transform coding, using the second spectrum;

identifying degrees of a CELP suppression of an amplitude of the first spectrum for the first band and the second band based on the determination result;

suppressing an amplitude of the first band of the first spectrum and an amplitude of the second band of the first spectrum, based on the identified degrees of the CELP suppression of the amplitude of the first spectrum and outputting a CELP component suppressed spectrum;

adding the CELP component suppressed spectrum and the second spectrum to calculate a decoded signal spectrum; and performing an inverse modified discrete cosine transform on the decoded signal spectrum, and outputting a decoded signal that is a speech/audio signal, wherein the degree of the suppression in the first band is a lower level than that in the second band, wherein the identifying includes determining whether a band determined to be the second band among the plurality of bands is a third band having a high pulse density or a fourth band having a low pulse density; and in the suppressing, the first spectrum in the third band is suppressed at a degree equal to or higher than suppression in the fourth band, and the first spectrum in the first band is suppressed at a degree lower than suppression in the fourth band, in the suppressing, the first spectrum at a frequency in which the pulses are not generated in the third band is suppressed at a higher degree than suppression in the fourth band, and the first spectrum at a frequency in which the pulses are generated in the third band is suppressed at the same degree as suppression in the fourth band, and at least one of the decoding the CELP coded data, the performing the modified discrete cosine transform, the decoding the transform coded data, the determining, the identifying, the suppressing, the adding and the performing the inverse modified discrete cosine transform is performed by a processor of an apparatus that includes a memory that stores instructions and the processor which executes the instructions.

* * * * *